US007448332B2

(12) United States Patent
Kearns

(10) Patent No.: US 7,448,332 B2
(45) Date of Patent: Nov. 11, 2008

(54) REFUSE DISPOSAL BY ENVIRONMENTALLY SAFE HIGH TEMPERATURE DISINTEGRATION

(76) Inventor: John Kearns, 1726 Old Number 5 Highway, Big Bras D'Or (CA) B1X 1A6

( * ) Notice: Subject to any disclaimer, the term of this patent is extended or adjusted under 35 U.S.C. 154(b) by 351 days.

(21) Appl. No.: 11/162,238

(22) Filed: Sep. 2, 2005

(65) Prior Publication Data

US 2007/0051288 A1 Mar. 8, 2007

(51) Int. Cl.
*F23G 5/00* (2006.01)

(52) U.S. Cl. ..... 110/346

(58) Field of Classification Search ..... 110/246, 110/185, 186, 187, 188, 190, 340
See application file for complete search history.

(56) References Cited

U.S. PATENT DOCUMENTS 3,842,762 A * 10/1974 Sargent et al. ..... 110/212
4,254,715 A 3/1981 LaHaye et al.
5,207,176 A * 5/1993 Morhard et al. ..... 110/246
RE34,298 E * 6/1993 Gitman et al. ..... 431/5
5,322,026 A 6/1994 Bay
5,366,699 A 11/1994 Milfeld et al.
5,374,403 A * 12/1994 Chang ..... 422/168
5,415,113 A 5/1995 Wheeler et al.

* cited by examiner

*Primary Examiner*—Kenneth B Rinehart
(74) *Attorney, Agent, or Firm*—Malin Haley DiMaggio Bowen & Lhota, P.A.

(57) ABSTRACT

A method and apparatus for burning material having a primary burner in the form of an elongated cylinder, the ends of the cylinder closed with stationary end walls. The cylinder is rotated about its longitudinal axis which is horizontal. A ram material inlet is provided in one end wall for compressing and feeding material into the cylinder. An air inlet conduit introduces air into the cylinder to promote burning of the material in the cylinder as the cylinder rotates. The combustion cylinder is maintained by an exhaust fan and air control valves at a pressure below atmospheric. A secondary afterburner is provided adjacent the primary burner that receives combustion gases from the primary burner. A cyclonic separator is positioned downstream of the gases burned in the afterburner. A programmable logic controller connected to air valves and sensors monitors the combustion process to sustain maximum combustion efficiency at temperatures above 1700 degrees Fahrenheit.

2 Claims, 5 Drawing Sheets

REFUSE DISPOSAL BY ENVIRONMENTALLY SAFE HIGH TEMPERATURE DISINTEGRATION

FIELD OF THE INVENTION

This invention relates generally to an environmentally safe, cost effective method and system for disintegrating refuse through combustion and, specifically, to a method and system for the disintegration of refuse through high temperature combustion in a primary combustion chamber where the refuse has a relatively long dwell and high temperature combustion of the exhaust gases generated in the primary combustion chamber in an afterburner where the gases have a short dwell time. Combustion efficiency is continuously maintained by one or more air flow control valves and one or more programmable logic controllers.

DESCRIPTION OF RELATED ART

One of the most vexing problems facing industrialized nations is the disposal of the large volume of refuse being generated daily in most city and urban environments by the population. The ever-increasing volume of organic and non-organic materials that must be disposed of on a daily basis in a modern urban society is reaching levels of which landfills cannot accommodate, levels that are not environmentally friendly and levels of air pollution through modern day incineration plants that are not acceptable for environmental standards. Providing an environmentally-safe, cost-effective method of refuse removal without polluting the environment is one of the most important problems facing urban society today.

U.S. Pat. No. 4,254,715 issued Mar. 10, 1981 to LaHaye, et al. describes a solid fuel combustor and method of burning. This system shows a static mass burn method incorporating an over and under-grate system which is not suitable for unsorted refuse. U.S. Pat. No. 5,415,113 issued May 16, 1995 to Wheeler, et al. shows a portable incineration apparatus. This unit requires sorting and raking to keep the unit clear during the combustion process. U.S. Pat. No. 5,322,026 issued Jun. 21, 1994 to Bay shows a waste combustion chamber with a tertiary burning zone. Again, this unit demands sorting and raking and is a static burn chamber. U.S. Pat. No. 5,366,699 issued Nov. 22, 1994 to Milfeld, et al. shows an apparatus for thermal-destruction of waste that uses a primary chamber and an afterburner for removing pollutants. The system is static in operation and does not provide for any rotary motion for complete combustion.

None of the above systems shows the use of high temperature disintegration using a rotary kiln in conjunction with oxygen, air flow control and an afterburner to achieve very thorough disintegration while, at the same time, remaining environmentally safe with the exhaust gases being cost effective for generating energy.

SUMMARY OF THE INVENTION

A system for and method of disintegration of non-radioactive refuse that is environmentally safe and cost effective and which can produce recoverable energy that uses high temperature combustion in a first primary combustion chamber (primary combustor) that rotates during the combustion process and a secondary combustion chamber or afterburner for combusting the exhaust gases removed from the primary combustion chamber.

The primary combustor comprises a rotatable, cylindrical kiln or combustion chamber that acts as the primary and main refuse combustor. The cylindrical kiln is mounted to rotate about its longitudinal axis which is positioned parallel to the earth. Compressed refuse, which can be organic or non-organic, and, in fact, any refuse other than radioactive material, is forced into the primary combustor through a ram that compresses the refuse material and forces the compressed material to be deposited inside the rotating kiln where the material expands and falls by gravity to the inside wall of the kiln. The rotation rate of the cylindrical kiln determines the angle of repose with respect to the movement longitudinally and transfer of refuse as refuse is disintegrating due to the high temperature of combustion along the lower portion of the cylindrical kiln during rotation. The actual rotation rate of the kiln can be adjusted depending on the specific type of refuse being burned.

The rotary kiln receives an ambient air input pipe approximately near the longitudinal axis of the kiln. The air input pipe provides ambient air drawn into the primary combustor during rotation to sustain high temperature combustion of the refuse during operation. Ambient air from the air intake pipe is drawn into the combustion chamber due to the creation of a lower internal pressure inside the rotating kiln created by an induced draft fan downstream of the exhaust gases being removed from the rotating kiln combustion chamber into an afterburner or secondary combustion chamber for the exhaust gases from the primary combustor. The suction created by the induced draft fan on the exhaust gases produce a lower internal pressure inside the primary combustor, allowing for the addition of ambient air through an air intake valve system to sustain desired primary chamber combustion temperatures, preferably around 1900 degrees Fahrenheit. The intake valve is controlled by a programmable logic controller connected to sensors mounted throughout the system. The high temperatures ensure maximum disintegration of the refuse.

The system provides for accumulating refuse in a solid waste receptacle that has a ram that inputs into the primary combustor. Also used is a liquid waste burner that can be used to inject liquid waste to be burned into the primary combustor through a separate inlet conduit under pressure. Finally, the primary combustor also has an auxiliary fuel burner that can be used to initiate the combustion process by pouring fuel oil into the primary combustor along with solid waste that is compressed and deposited into the primary combustor for ignition with the fuel oil to start the combustion process. Once combustion is started, the auxiliary fuel burner is shut off automatically and is not needed.

A fan may be used with the inlet air pipe to force air into the primary combustor even though there is a lower gas pressure in the primary combustor to control the amount of oxygen flowing into the primary combustor during operation. This fan is controlled by a programmable logic controller that can also control other combustion variables that will be described herein for sustaining the desired high temperature combustion rates in the rotary kiln and also in the afterburner for the gases.

The primary combustor which is a cylindrical kiln can be mounted on hydraulically driven rotating rollers that cause the entire kiln to rotate by applying rotational energy to the outside surface of the kiln.

The afterburner (secondary combustion chamber for gases) is a tubular chamber in fluid communication with the primary combustor that receives exhaust gases from the primary combustor. The afterburner is constructed much like a conduit that can sustain very high temperatures for allowing the exhaust gases from the main combustor to be thoroughly burned for complete combustion of the gaseous materials and for transfer of the gaseous materials into a cyclonic separator. The afterburner includes an inlet opening that has a target oxygen control valve that can be opened or closed by a programmable logic controller (PLC). The control valve can be a solenoid operated control valve. The PLC is connected to the induced draft fan, the intake fan, temperature sensors, and one or more pressure sensors mounted throughout the system for controlling the overall combustion process to sustain high temperature combustion in the primary chamber and in the afterburning chamber. The desired combustion in the afterburner should be in the 2200 degrees Fahrenheit range to ensure complete disintegration and gas combustion (no unburned gases). The afterburner may also include an auxiliary fuel inlet burner for initiating combustion of the gases upon initial start up in the main combustor.

With respect to the compacted solid waste that has been fed by ram into the primary combustor during the combustion process in which the temperatures are at least 1900 degrees Fahrenheit, the resultant disintegrated material is a fine ash that is controlled by movement of the rotary kiln along the bottom floor as the kiln rotates toward the distal end of the rotating kiln relative to the proximal end where the initial solid waste is introduced. During the combustion process in the primary combustor, the volume of the refuse relative to the internal volume of the rotatable kiln during combustion is maintained at about approximately 18 percent. The ash can be removed from the distal end and deposited on a conveyor belt.

The exhaust gases exiting the afterburner are directed into a cyclonic separator from the afterburner in which particulate ash through cyclonic action within the separator is separated again from the exhaust gases themselves. The cyclonic separator ensures that particulate pollutants are not allowed to be transmitted into the ambient air in the exhaust system by capturing particulates prior to the exhaust gases being exposed to the ambient environment.

As a further environmental safeguard, the exhaust gases, once leaving the cyclonic separator, are drawn by the induced draft fan through a heat exchanger that includes a plurality of cooling air fans and exhaust gas tubes that allow for additional cooling of the exhaust gases prior to their being discharged through an elevated stack. A final filtration of the exhaust gases is accomplished in an air control system that includes air filtering that again removes any particulate ash that may be left in the exhaust gas stream after temperature reduction to ensure no particulates are expelled from the stack. The induced draft fan is mounted downstream of the air quality control system and is the fan that provides for exhausting the exhaust gases all the way back from the primary combustor through the afterburner, the cyclonic separator and the heat exchanger with the cooling air fans. The fan then discharges the exhaust gases into a vertical stack at which point the exhaust gases are approximately 250 degrees Fahrenheit.

An air valve control system that includes one or more programmable logic controllers is connected to a plurality of sensors located throughout the system for temperature, oxygen content, operating pressures, and any other variables that are required to be measured. The PLC is also connected to the air input fan, the target oxygen control valve and the induced draft fan for maintaining desirable combustion temperatures and air quality in the primary combustor and the afterburner.

In the set up of the overall system, the residual ash can be removed by an ash discard conveyor system in combination with an ash discard cooling conveyor for ultimate removal. Also, the system provides for in-feed refuse material handling that allows the refuse to be pre-positioned for introduction into the hydraulic ram feed unit that directly compresses the refuse without sorting into a first stage ram feed laterally and then a second stage ram feed longitudinally that forces and compresses refuse from a confined ram feed unit directly into the primary combustor during the combustion process. The inlet ram feed main conduit includes a movable wall forcing the refuse into the main combustion chamber. Note that since the refuse is being compressed as it is forced into the primary combustor, there is no leakage of exhaust gases from the primary combustor out through the ram feed.

Using the present system and method, large amounts of refuse of any type, organic and non-organic (as long as it is not radioactive) can be successfully disintegrated to a small volume in an environmentally safe system in which the exhaust gases can be vented to the atmosphere without harming the environment. The resultant ash is safely removed free of toxic materials, bacteria, and viruses. Because of the high operating temperatures, heat can be used and recovered from the process for generating energy that is recovered from the overall process, making the method even more cost effective.

Using the present invention for refuse and waste disposal, the method and system can accept all types of refuse, organic or non-organic, except radioactive waste. Further, the system does not use a grate system and does not employ quenching tanks. The present invention operates at high, primary combustor temperatures of 1995 degrees Fahrenheit and high exhaust gas temperatures at 2200 degrees Fahrenheit. Material handling is minimized while accomplishing almost 100 percent combustion in the primary combustor. The ash discard is totally inert and, therefore, reduces landfill by 83 percent exceeding environmental requirements.

The system can be interfaced with an energy system for generating steam to run turbines for electric power generation or steam for heating buildings and residential dwellings and even desalinization and water purification.

It is an object of this invention to provide a cost effective, environmentally safe method and system for the disintegration of all non-radioactive refuse utilizing a primary combustion chamber that includes a rotating kiln and a secondary combustion chamber or afterburner for exhaust gases.

It is another object of this invention to destroy waste streams using intense heat for very high burning efficiency with extremely low exhaust emission levels with a total waste volume reduction of approximately 86 percent.

In accordance with these and other objects which will become apparent hereinafter, the instant invention will now be described with particular reference to the accompanying drawings.

DETAILED DESCRIPTION

Figure 1:
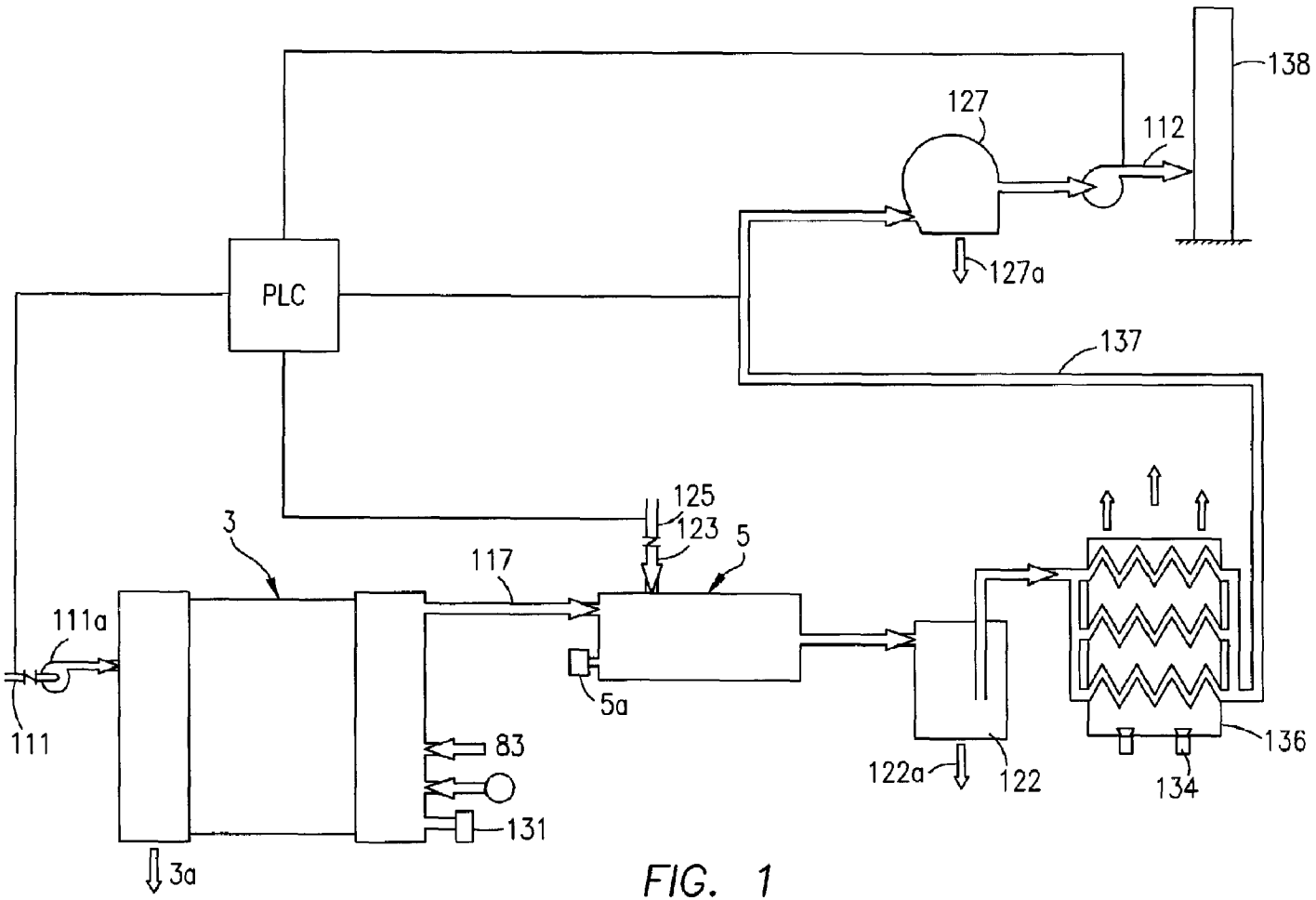
FIG. 1 is a schematic diagram showing the method of operation of an example of the invention.

Referring now to the drawings and, specifically, FIG. 1, an example of the method of operation of the present invention is shown schematically. The primary combustor 3 for disintegrating the solid refuse is a rotary kiln 3 that receives solid waste that has been compressed by a ram feed through inlet 83. The volume of refuse in the rotary kiln is about 20 percent with 80 percent being excess air. An inlet air fan 111*a* provides for inlet air into the kiln. A more detailed description of the kiln is provided below. The exhaust gases from the kiln resulting from combustion and disintegration of the refuse at high temperature exits through conduit 117 into an afterburner 5 that can receive target oxygen for controlling the combustion in afterburner 5 through an air inlet 123 that includes a control valve connected to a programmable logic controller (PLC). The temperatures in afterburner 5 can reach up to 2200 degrees Fahrenheit for complete combustion of the exhaust gases. The exhaust gases are then sent to a cyclonic separator 122 that can remove any particulates such as ash particulates from the gases that leave the afterburner 5. An induced draft fan 112 draws the exhaust gases through the system from the rotatable kiln 3.

The gases then that are discharged from the cyclonic separator 122 are directed into a heat exchanger 136 that has cooling air fans 134 that blow cool air through the heat exchanger pipes for recovering energy.

An air quality control system 127 that includes air filters receives the exhaust gases that are then sent to an exhaust stack 138. The gases the stack 138 at approximately 250 degrees Fahrenheit. The induced draft fan 112 is responsible for providing suction throughout the entire system from the combustion chamber 3 through afterburner 5, cyclonic separator 122 and the heat exchanger 136. The system may have thus two fans such as 111*a* that provides outside air under pressure into the combustion chamber while, at the same time, having an induced draft fan 112 that draws all the gases through the system to stack 138 for discharge into the atmosphere. The amount of air received into the primary combustor 3 can be controlled with a valve 111 that controls the flow of air through fan 111*a* and through the target oxygen control valve 123 connected to a programmable logic controller (PLC) that allows and controls the amount of oxygen received in the afterburner 5. Afterburner 5 can also include an auxiliary fuel burner to enhance combustion, if necessary.

With respect to the cyclonic separator 122, separation of air and ash particulates can allow for the removal of ash represented by arrow 122*a*.

The refuse combustion, once started, is self-sustaining by providing a continuous flow of refuse. Complete disintegration results in ash being removed at outlet 3*a* from the primary combustor, from the cyclonic separator 122, and from the air quality control filters at 127*a*. Heat captured in the heat exchanger 136 can be used for other energy purposes such as generating electricity.

Figure 2:
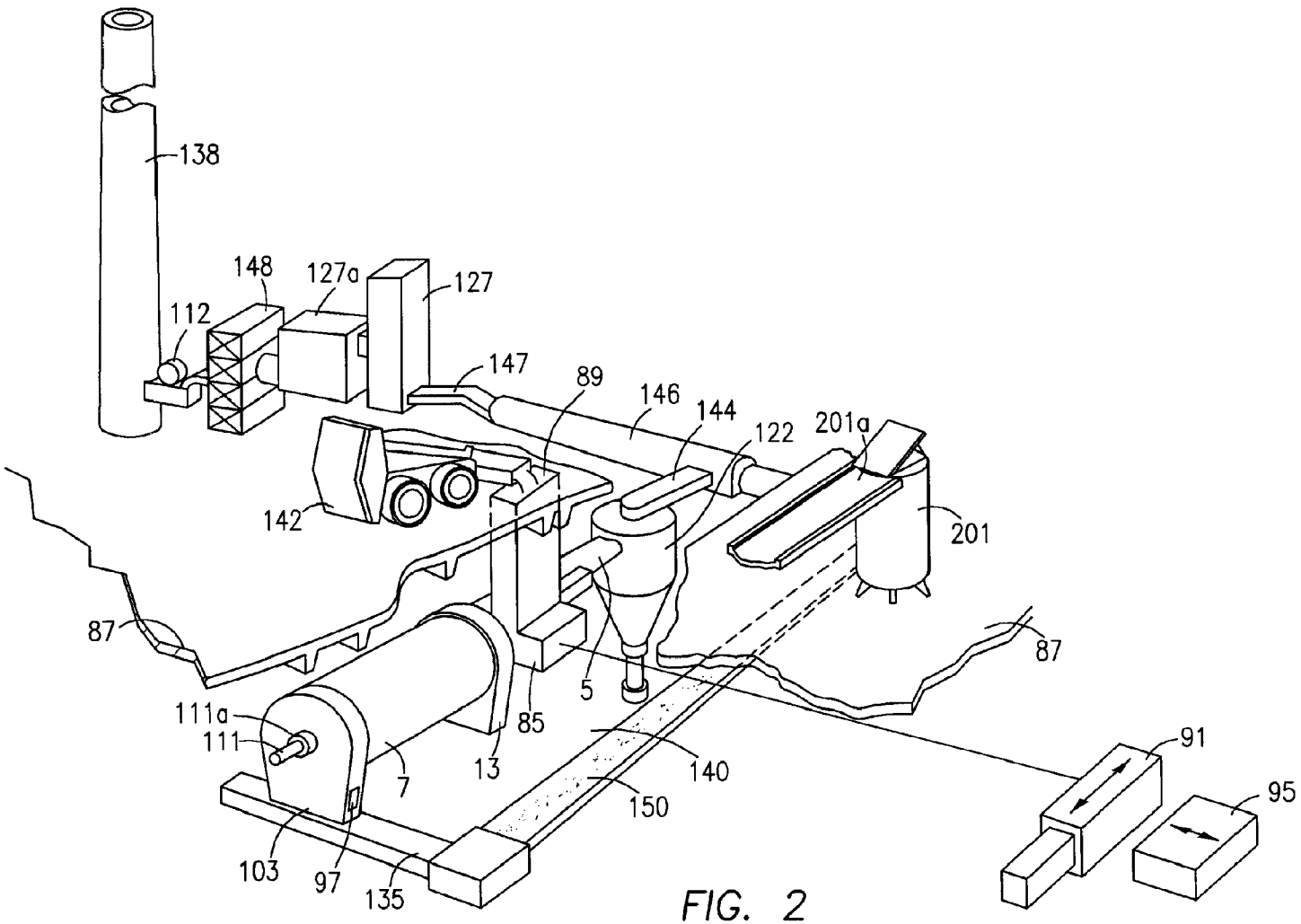
FIG. 2 is a schematic diagram showing an example of the system.

Referring now to FIG. 2, an example of a disintegration waste refuse system is shown as a modular cutaway that includes a tipping room. Thus, the basement machinery room is shown at 140, with a waste reception floor shown as 87, the level where the initial solid refuse waste is received. A vehicle 142 can dump solid refuse through opening 89 into a refuse receptacle 85 that is received through a hole 89 in floor 87. The solid is compressed in a hydraulic ram feed unit in receptacle 85 that includes a pair of hydraulically actuated rams 91 and 95 which are described in greater detail below. The refuse is then compressed and forced into the combustion chamber 7 which rotates and in which the primary combustion of the refuse takes place.

As shown in FIG. 2, after the gases leave the cyclonic separator 122, the gases travel through flue runs 144 and 146 to the pollution control system 127 and 127*a*. This is where the air quality control system includes air filters and also removes any remaining ash in the combustion gases. The gases are then discharged through the tipping room wall 148 through the induced draft fan 112 into the stack 138 for discharging the gases into the ambient environment. The gases, at this point, are estimated to be approximately at 250 degrees Fahrenheit.

As shown in FIG. 2, an additional static burner 201 can be utilized and connected into the system also which is further described as an example for an alternative embodiment of the invention down below. A preload conveyor for the refuse 201*a* is shown that leads into the static burner or oversized waste combustor. This could be for materials too large to be combusted in the normal primary combustion chamber 7, such as tree trunks or stumps, or require combustion time greater than normal excursion time through the primary combustor. This also includes an ash discard cooling conveyor 150 for discharging the ash.

Figure 3:
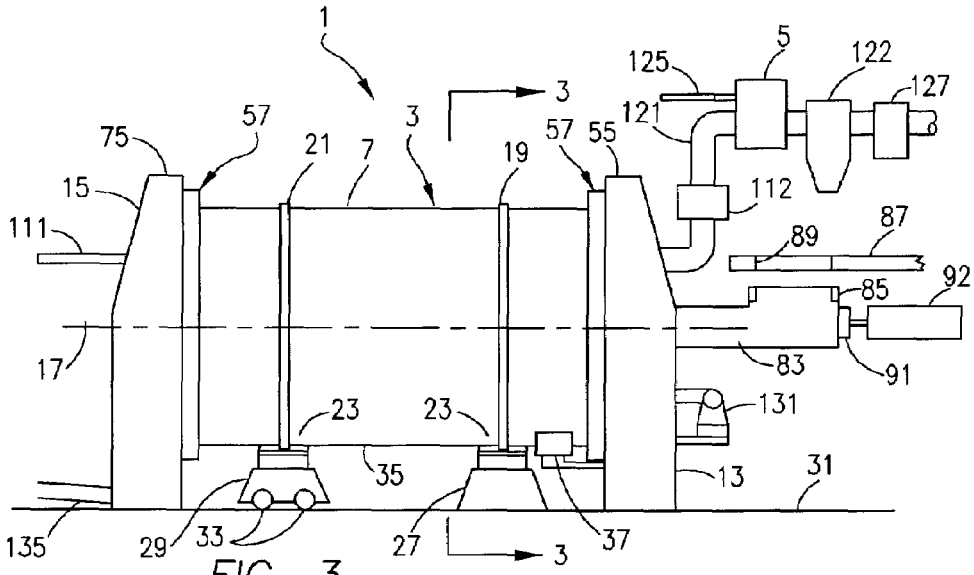
FIG. 3 is a side elevational view of an example of the system.

The apparatus 1 of the present invention, as shown in FIG. 3, has a primary burner 3 and a secondary or afterburner 5. The primary burner 3 burns mainly solid refuse at a temperature ranging between 1,700 and 2,200 degrees Fahrenheit while the afterburner 5 burns the gaseous products of combustion from the first burner 3 at a temperature ranging between 1,700 and 2,200 degrees Fahrenheit.

Figure 4:
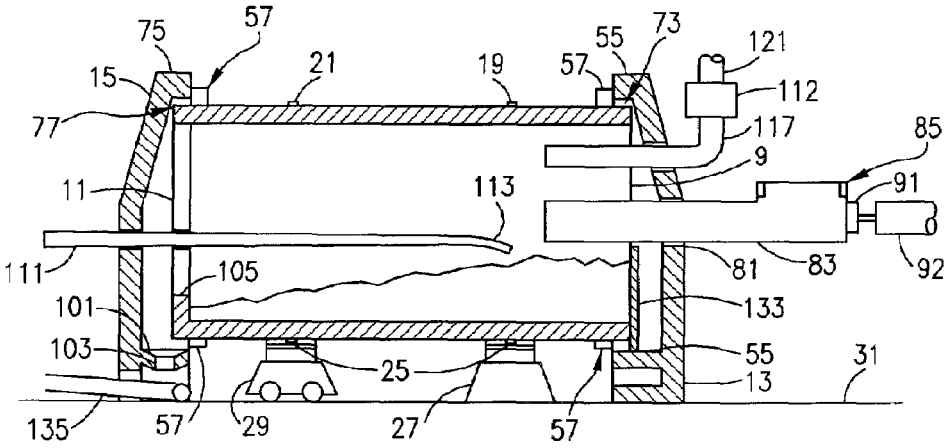
FIG. 4 is a side view in cross section of the first primary combustor.
Figure 5:
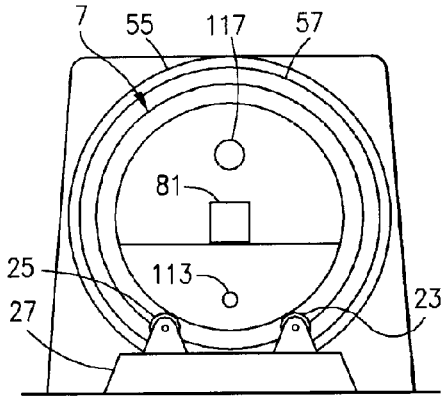
FIG. 5 is a side elevational view in cross section of the primary combustor taken along line 3-3 in FIG. 3.

The primary burner 3, as shown in FIGS. 3, 4 and 5, has an elongated cylinder 7 having open circular ends 9, 11, the ends 9, 11 closed by fixed end walls 13, 15. The cylinder 7 is mounted to be rotated about its longitudinal axis 17. To this end, the cylinder 7 has two longitudinally spaced-apart circular riding rings 19, 21 mounted about the circumference of the cylinder. Each riding ring 19, 21 is mounted on two pairs of trunnions, pair 23 on one side and pair 25 on the other side respectively, under the cylinder 7. Each pair of trunnions 23 and 25 is mounted on a floor support 27, 29 respectively. One floor support 27 is fixed to a floor 31. The other floor support 29 rests on the floor 31 via wheels 33. The wheels 33 allow the floor supports 27, 29 to move relative to each other in a longitudinal direction as the length of the cylinder 7 changes due to heating. The longitudinal axis 17 of the cylinder 7 is horizontal when the cylinder 7 is mounted on the trunnions 23, 25 and the trunnions support the cylinder 7 for rotation as will be described.

The pairs of trunnions 23 and 25 are each rotatable about an axis parallel to the longitudinal axis 17 of the cylinder 7. Two trunnions 23 on supports 27, 29 are aligned on one side of the cylinder 7 and two other trunnions 25 are aligned on the other side of the cylinder. Each aligned pair 23 and 25 of trunnions can be joined by common drive shafts 35 (one drive shaft on each side), each shaft 35 rotated by a motor 37. However, a back-stop clutch separates the two so as to allow for dual drive backup should any one side fail, thereby permitting continuous operation until the unscheduled maintenance has been done. Operation of the motor 37 will rotate the shafts 35, and the set of trunnions 23 on the common shaft 35, causing rotation of the cylinder 7 through the riding rings 19, 21 on the cylinder contacting the trunnions 23 and 25.

Figure 6:
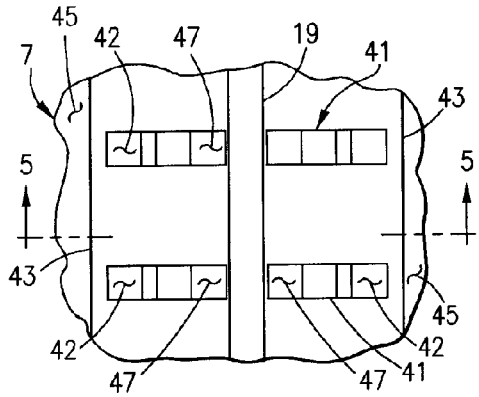
FIG. 6 is a cutaway bottom plan view of the drive ring.
Figure 7:
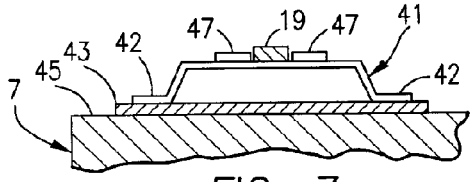
FIG. 7 is a cutaway cross sectional view of the drive ring taken along line 5-5 in FIG. 6.

Each riding ring 19, 21 can be mounted on circumferentially spaced apart supports 41 on the cylinder 7 as shown in FIGS. 6 and 7. The supports 41 are raised and are attached at their ends 42 in a circle to a circular reinforcing band 43 which in turn is mounted on the outer surface 45 of the cylinder. Retaining plates 47 are fastened to the top of the supports 41 to retain the riding ring between them centered on the supports 41.

Figure 8:
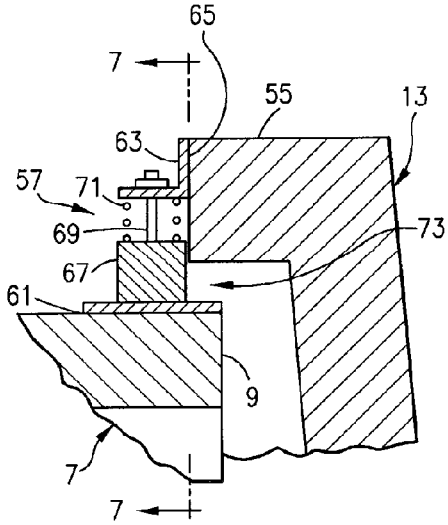
FIG. 8 is a cutaway cross sectional view of the seal means.
Figure 9:
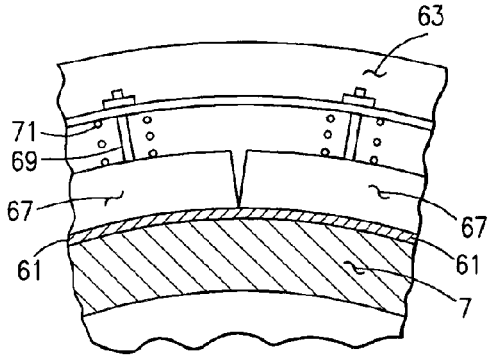
FIG. 9 is a cross sectional view taken along line 7-7 in FIG. 8.

Each open end 9, 11 of the cylinder 7 is closed by a fixed end wall 13, 15. The end walls 13, 15 are mounted on a sub-frame 31. The first or material inlet end wall 13 has a circular sleeve 55 that extends inwardly therefrom to encircle the cylinder 7 adjacent its end 9. A seal 57 is provided between the sleeve 55 and the end 9 of the cylinder 7. The seal 57, as shown in FIGS. 8 and 9, has a sacrificial wear band 61 on the outer surface 45 of the cylinder 7 adjacent its end 9. A mounting ring 63 is mounted on the inner edge 65 of the sleeve 55, overlying the wear band 61 but spaced radially outwardly therefrom. A plurality of ceramic seal segments 67 are mounted in a circle about the wear band 61, the segments 67 abutting serially about the circumference of the wear band 61. Each segment 67 is connected to the mounting ring 63 by a pin or bolt 69 and is free to move radially along the pin 69. A spring 71 is mounted between each seal segment 67 and the mounting ring 63, about the pin 69, to tension each seal segment 67 against the wear band 61. Each seal segment 67 also abuts tight against the inner edge 65 of the sleeve 55. The seal segments 67 seal the gap 73 between the end 9 of the cylinder 7 and the circular sleeve 55 on the end wall 13. The second, material outlet, and wall 15 also has a cylindrical sleeve 75 that extends inwardly therefrom to encircle the other open end 11 of the cylinder 7. A seal 57 also seals the gap 77 between the other end 11 of the cylinder 7 and the other sleeve 75 on the end wall 15.

While one form of retaining the seal segments 67 has been shown, other retainers can be employed. Although the system is held at a lower than ambient pressure, annular covers or shrouds, not shown, could be provided over the seals 57 to collect any gas leakage past the seals and to direct the collected gases to the second burner.

Figure 10:
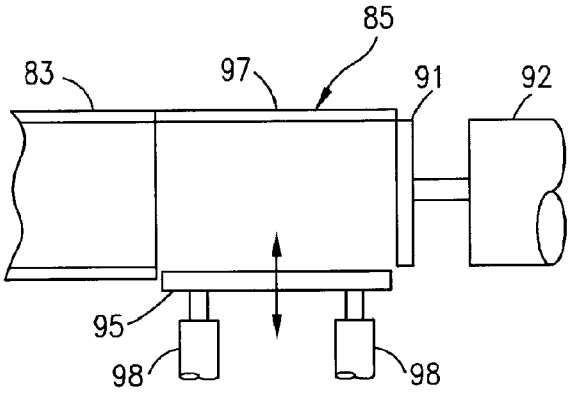
FIG. 10 is a cutaway top plan view of the refuse receptacle rams.

End wall 13 has an inlet passage 81 (FIG. 4) therein for allowing entry of refuse material into the cylinder 7 where the refuse is burned. A tubular conduit 83 leads from an open refuse receptacle 85 through the inlet passage 81 into the cylinder 7 as shown in FIGS. 3 and 4. The refuse receptacle 85 is below a dumping floor 87. Refuse is dumped into the receptacle 85 through an opening 89 in the floor 87. A refuse compacting ram 91 passes through the receptacle 85 from one side of the receptacle into the conduit 83 to compact and push refuse from the receptacle 85 into the conduit 83 and through the conduit 83 into the cylinder 7 through the inlet 81 in the end wall 13. Hydraulic actuator 92 operates the ram 91 back and forth. The two stage ram-feed plunger is described in greater detail below. The compacted refuse in the conduit 83 seals the conduit so combustion products from within the cylinder 7 cannot pass out through the conduit 83 and the receptacle 85. Preferably one side wall 95 of the receptacle 85 can be moved toward the opposite, fixed, side wall 97 of the receptacle in a direction transverse to the direction of movement of the ram 91 as shown in FIG. 10. The side wall 95 can be moved by suitable hydraulic actuator 98 toward the other side wall 97 to initially compress the refuse load within the receptacle 85 in one direction before the refuse is compressed and pushed through the conduit 83 in a transverse direction by the ram 91*a*. The conduit 83 and the ram 91 preferably have a square or rectangular cross sectional shape to minimize blockage of the conduit 83 by certain materials contained in the refuse.

Figure 11:
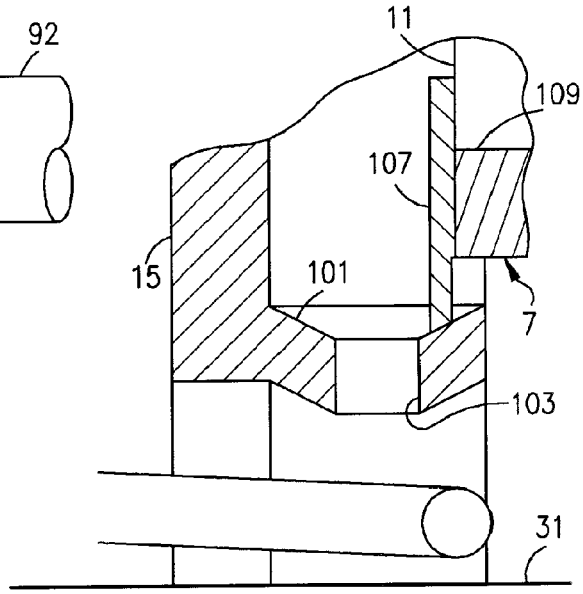
FIG. 11 is a cutaway view in cross section of the residue outlet of the first burner.

Referring to FIG. 11, the other end wall 15 closing the cylinder 7 abuts a discharge port 103 from the end wall 15 to terminate just below the bottom of the cylinder 7 adjacent end 11. The ashes, which have traveled the length of the cylinder 7 from the one end 9, to the other end 11, drop through the discharge outlet 103 continuously onto a metal pan conveyor to accommodate the high temperatures of the solids and molten glass nodules.

The cylinder 7 can have a lip 105 adjacent end 11 extending radially inwardly as shown in FIG. 4. The lip 105 serves as a barrier to retain the material being burned for a slightly longer period of time within the cylinder 7 to promote more complete burning.

As shown in FIG. 4, an air inlet pipe 111 connected to the exhaust end of fan 111*a* extends through the outlet end wall 15 to an air distributor 113 located generally centrally within the cylinder 7. The air inlet pipe 111 directs air into the cylinder 7, through the distributor 113, to promote burning of the refuse. The air is directed tangentially against the material as the material leaves the inner surface of the cylinder 7.

An exhaust outlet 117 is provided within the first, inlet, end wall 13 leading to the secondary or afterburner 5 via an exhaust conduit 121. Gaseous combustion products leave the cylinder 7 through the exhaust outlet 117 and are burned in afterburner or secondary burner 5. The remaining products are then passed through a cyclone separator 122 and an air filter 127 to clean the products of combustion from the secondary burner 5. An air pipe 125 brings air to the secondary burner 5 to support combustion therein. An induced draft fan 112 is preferably provided in the exhaust conduit to draw out the primary combustion products from the cylinder 7 of the primary burner 3 and to provide a pressure within the cylinder 7 that is slightly less than atmospheric. Thus, any air flow will be into, rather than out of, the cylinder 7.

A small oil burner 131 is preferably mounted in the first, inlet end wall 13 of the primary burner 3 and is used to start the burning of the refuse fed into the cylinder 7. Once burning of the refuse is started within cylinder 7, the oil burner 131 can be shut down. The burning of the refuse will continue without the need of fuel oil.

The operation of the system will now be described. Refuse is loaded into the receptacle 85, compressed longitudinally therein by ram 91 and laterally by ram 95, and pushed through the conduit 83 and inlet opening 81 in the end wall 13 into one end of the cylinder 7 where the refuse is initially ignited by the oil burner 131. The cylinder 7 is continuously rotating about its longitudinal axis 13 as the feed of refuse material into the cylinder 7 commences. The refuse material, as it is fed in and tumbled during rotation of the cylinder, makes an angle of repose within the cylinder, high toward the inlet end and low toward the outlet end. A retaining wall 133 can extend up from the bottom of sleeve 55 adjacent the end 9 of the cylinder 7, as shown in FIG. 4, to retain the material in the cylinder 7.

The compacted refuse expands as the refuse is fed into the cylinder 7 which promotes ignition and burning of the refuse. The ignition zone of the refuse, comprising about one-quarter the length of the cylinder 7, is adjacent the inlet end 9 of the cylinder 7. The tumbling action of the refuse as the cylinder 7 rotates also promotes burning. The air fed into the cylinder 7 through the air pipe 111 further promotes burning of the refuse. The flue gases in the exhaust conduit 121 are monitored to measure the amount of oxygen therein. The amount of air fed through the air pipe 111, and the rate at which refuse is fed into the cylinder 7, is controlled so that the oxygen content of the flue gas is kept at appropriate levels depending on waste type being processed. The temperatures in the primary combustor and secondary burner (afterburner) are also sensed and used to control the amount of air fed into both the primary and secondary burners and the rate of feed of the refuse into the primary combustor. This ensures a hot burning temperature for the refuse and more complete combustion with little left-over residue. The hot burning zone for the refuse, comprising about one-quarter the length of the cylinder, is adjacent the ignition zone for the refuse, and closer to the middle of the cylinder 7. The residue remaining is about 17% of the total volume of material fed into the cylinder 7 of the burner 3 and is in the form of dry sand-like ash and rock-like nodules. This residue material (ash and nodules) pass to and out through the outlet 103 in the other end wall 15. As the residue passes to and through the outlet 103, this residue material is no longer burning. It is important that the combustion gases are exhausted out of the inlet end wall 13 of the burner. This allows the residue remaining in the burner 3 to cool as the residue moves toward the outlet 103. As the residue drops out of the outlet 97, onto a conveyor 135 for disposal, the residue does not burn and so is easier to dispose of. The refuse material in the cylinder 7 of the burner 3 slopes down toward the outlet end 11 from the inlet end 9. The dwell time for the refuse in the cylinder 7, for a machine which handles about 20 tons of refuse material per day, is around twenty minutes, the time taken for the material to move from the inlet end 9 to the outlet end 11 of the cylinder. The dwell time for the combustion gases in the afterburner is around two seconds.

The amount of air employed is less than that normally employed to burn refuse. This allows a hotter and more complete burn. The hotter burn reduces toxic materials and other pollutants in the refuse and also allows the burning of wetter refuse.

A typical installation would employ a cylinder 7 for the primary burner 3 that is about 16 feet long and about 6 feet in diameter. This size of cylinder could handle about 20 tons of refuse per day. The cylinder 7 is rotated at a speed providing one revolution of the cylinder in about one and a half minutes.

Figure 12:
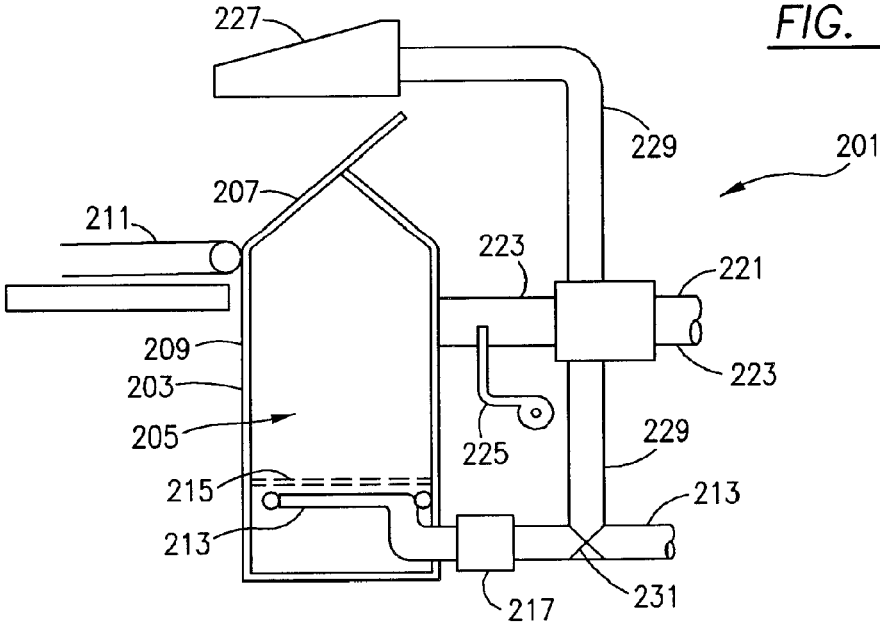
FIG. 12 is a side elevational view in cross section of another embodiment of the invention.

In another embodiment as shown in FIG. 12, the apparatus 201 could comprise a primary, upright, stationary, burner 203 having a combustion chamber 205 therein. An inlet door 207 in the wall 209 of the burner 203 is located above the combustion chamber 205. Feed means 211 feed refuse to the combustion chamber 205 through the door 207. An air pipe 213 brings air to the combustion chamber 205 below a refuse support grill 215 within the bottom portion of the chamber 205. A blower 217 can be provided in the air pipe 213.

A secondary or afterburner 221 is located next to the primary burner 203 and a flue duct 223 brings exhaust combustion gases from the combustion chamber 205 in the primary burner 203 to the secondary burner where the gases are burned. Secondary combustion air can be provided through line 225. A shroud 227 collects combustion gases above the door when open and directs the gases back into the chamber 205 though a return line 229 and a diverter valve connecting line 229 to air pipe 213. The temperature in the combustion chamber 205 and in the afterburner 221 are monitored to control the amount of air flow into the combustion chamber 205 and into the afterburner to achieve the desired combustion temperatures and rates.

All the combustion chambers described, in both embodiments, can be lined with suitable refractory material to enable them to withstand the high temperatures. While the material being burned has been described as refuse material, the material to be burned could be any combustible material and could even include non-combustible materials mixed with the combustible material.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. The method of disintegration of non-radioactive refuse for reducing air pollution and for producing recoverable energy comprising the steps of:

(a) providing a rotating cylindrical kiln as the primary refuse combustion chamber;

(b) feeding compressed solid refuse into said rotating kiln;

(c) initially igniting said refuse in said primary combustion chamber with an auxiliary fuel burner to initiate combustion;

(d) selecting a rotation rate of said kiln to achieve a desired angle of repose for the refuse during combustion;

(e1) providing an air inlet pipe into said rotating kiln along the center of the longitudinal axis of said cylindrical kiln;

(e2) providing an exhaust gas flow leaving said kiln into an afterburner resulting in a lower internal air pressure in said kiln below ambient pressure and drawing in said air in said air inlet pipe into said primary combustion chamber;

(e3) adjusting the oxygen input into said air inlet pipe to a level to sustain combustion of said refuse at about 1900 degrees Fahrenheit;

(f) burning the exhaust gases from said primary combustion chamber in said afterburner at about 1700 degrees Fahrenheit;

(f1) providing a fan downstream of said afterburner for drawing gases out of said afterburner;

(g) controlling the oxygen in said afterburner with an air inlet valve into said afterburner that also controls exhaust flow gases from said primary combustion chamber;

(h) moving said exhaust gases from said afterburner into a cyclonic separator;

(i) separating ash particulates from gases in said cyclonic separator;

(j) removing said gases from cyclonic separator using said downstream fan;

(k) passing said exhaust gases through a heat exchanger to remove heat from said exhaust gases;

(l) providing an air control system including a filter to separate ash particulates and remove them from said exhaust gases;

(m) mounting said fan downstream of said air quality control system; and (n) using said fan discharging said finally filtered gases into a gas discharge stack for discharge into the ambient air.

2. A system as in claim 1, including:

at least one programmable logic controller connected to said oxygen control valve to regulate combustion in said primary combustor.

* * * * *